US006962125B1

(12) United States Patent
Wesley

(10) Patent No.: US 6,962,125 B1
(45) Date of Patent: Nov. 8, 2005

(54) TIDE BUSTER CONVERTIBLE STAIR

(76) Inventor: William P. Wesley, 473 Waters Dr., Ft. Pierce, FL (US) 34946

( * ) Notice: Subject to any disclaimer, the term of this patent is extended or adjusted under 35 U.S.C. 154(b) by 0 days.

(21) Appl. No.: 10/905,652

(22) Filed: Jan. 14, 2005

(51) Int. Cl.[7] ..... B63B 17/00

(52) U.S. Cl. ..... 114/362; 182/86

(58) Field of Search ..... 114/362

(56) References Cited

U.S. PATENT DOCUMENTS 3,570,029 A * 3/1971 Hunsaker ..... 114/362
4,021,071 A * 5/1977 Norman ..... 296/62
5,123,372 A * 6/1992 Kobayashi et al. ..... 114/362

* cited by examiner

*Primary Examiner*—Jesus D. Sotelo
(74) *Attorney, Agent, or Firm*—Joel I. Rosenblatt

(57) ABSTRACT

A ladder system consists of a base and extension and a system for connection of the base to the extension for vertical height extension or horizontal lenght extension or for nesting the extension steps in the base for storage.

26 Claims, 5 Drawing Sheets

TIDE BUSTER CONVERTIBLE STAIR

DESCRIPTION

1. Field of the Invention

The invention relates generally to convertible steps with hinged, or repositionable parts, to change the elevation and length of the steps to fit a range of height.

2. Background of the Invention

Boaters, particularly boaters of the yacht class, who use a dock of a fixed or permanent height, must have for ready use, a step system for transit from the boat to the dock. In tidal waters, the level of the dock relative to the boat, changes about every six hours with the rise and fall of the tide. This tide change brings with it a change in the deck level of the boat relative to the dock level and a change in the height of a step system for transit from the dock to the boat deck or the reverse transit. In another instance, the horizontal distance between the boat deck and the dock may unexpectedly change, for example when the boat is removed from its own dock and brought to a visited dock. At that time, a step system may be needed to allow transit of a larger horizontal distance from boat deck to dock, as well and a larger or lesser horizontal distance.

As is well known, boats by their very nature must economize space. Storing a plurality of stairs of varying height in the vertical or width in the horizontal, for transit from the boat deck to a dock would use valuable space, needed for other purposes. At the same time, stair or step systems, are easier to use than expandable or collapsing or retractable ladder systems and better adapted to the purpose of private boating, and use of the owner and guests.

Accordingly, it is an object of this invention to provide a step system with individual steps placed relative to each other to afford a suitable step support, with base steps and an extension step or stair system, displacable vertically and horizontally, for a safe and comfortable transit from boat deck.

In another object of this invention to provide a step system with hinged, and translatable or relocatable parts for adapting the height of the step system to a changing height between the boat deck and a dock for example and the horizontal distance between the boat deck and the dock.

SUMMARY

The present invention is directed to an adjustably repositionable step system with at least one removable or transformable, and repositionable part for spacial translation and re location to change its vertical or horizontal displacement of the step stair system.

The step stair system assembly is built on a step base with a plurality of base steps mounted, for example on the deck or sides of a boat and allowing transit from the deck to at least the boat topside or gunwale. The steps may have a plurality of shapes and in a preferred embodiment, the step area, the horizontal displacement and the vertical rise between steps, is chosen with conventional ergonomics in mind, as would be known to those skilled in the art. For example, the step may be aligned with each other as in well known and conventional stairs.

The step system, according to the disclosed inventive principles, utilizes a removable and relocatable, or repositionable, or transformable, step extension which may be mounted on the step base in a plurality of positions whereby, in a first position, the vertical displacement or height of the step system may be extended, or in a second position, the horizontal displacement or horizontal length of the stair system may be extended or in a third position, the step extension may be stored by transforming its position to nest in the step base. In this way, the extension step may be stored approximately in the space used for the base step and at the same time, may be used at part of the base step, for example when the extension is not needed.

According to the disclosed inventive principles, the step extension, in a preferred embodiment, may have one or more of the separate individual steps mounted for translation on a hinge or pivoting connection, as shown in a preferred embodiment, for rotating the separate hinged steps into place in between the other steps of the step extension in a nesting manner, when there is a need for a vertical displacement adjustment.

According to the disclosed inventive principles, the step extension may be removed and relocated relative to the step base and its first position, where the step extension is connected to the step base for maximum vertical height, for example, by rotation, to invert the extension to extend the horizontal length of the step system in its second position. Or, the versatility of the step system may be extended by removing and relocating the step extension on the step base, relative to the first position, in an inverted and rotated position, or rotated relative to the second position, to place the step extension in a nested manner in between the steps of the step base for compact storage, for example when underway. What is shown and described according to the disclosed inventive principles is the following.

An expandable self storing ladder used aboard a vessel, and adaptable for length or height extension to accommodate varying displacements of the vessel from an intended location, comprising, first means for stepping from a vessel; the first means including means for steps and means for attachment to the vessel; the first means including second means for connection with the first mens and for extending the first means in a plurality of positions; the first means including third means for detachably connecting the second means in a first position with the second means extending in a first direction for vertical extension, and in a second position with the second means extending in a second direction for horizontal extension.

As shown and described, the third means includes means for connecting the second means inverted in the second position relative to the first position, and for connecting said second means in a third position for storage and the third means for connecting said second means to said first means in said third position for storage, includes means for connecting said second means, rotated and inverted, relative to said first position.

As shown and described in a preferred embodiment is an adjustable step ladder compensating for varying displacement of a boat from the surface of a dock due tide changes or for a changed arrangement of docking facilities, with a step base ladder; a step extension ladder; a connection system including step base connections system mountings and a step extension connection system mountings arranged for connection in a first position for extending said step base vertically, in a second position for extending said step base horizontally, or in a third position for nesting said step extension with said step base for storage.

As shown and described in a preferred embodiment is a method for using an expandable self storing ladder used aboard a vessel, to accommodate varying displacements of the vessel from an intended transfer location, with the steps of, attaching a step base to a vessel; arranging a step extension on said step base in a first position for extending said step base vertically, in a second position for extending said step base horizontally, or in a third position for nesting said step extension with said step base.

As shown and described is the adjustable step ladder in the third position with the step base connection system mountings and step extension connection system mountings, arranged in opposition, and said said steps of said step base and said step extension, are nested.

These and other features and advantages of the invention as shown herein according to the disclosed inventive principles in a preferred embodiment, will be disclosed herein.

DETAILED DESCRIPTION

Figure 1:
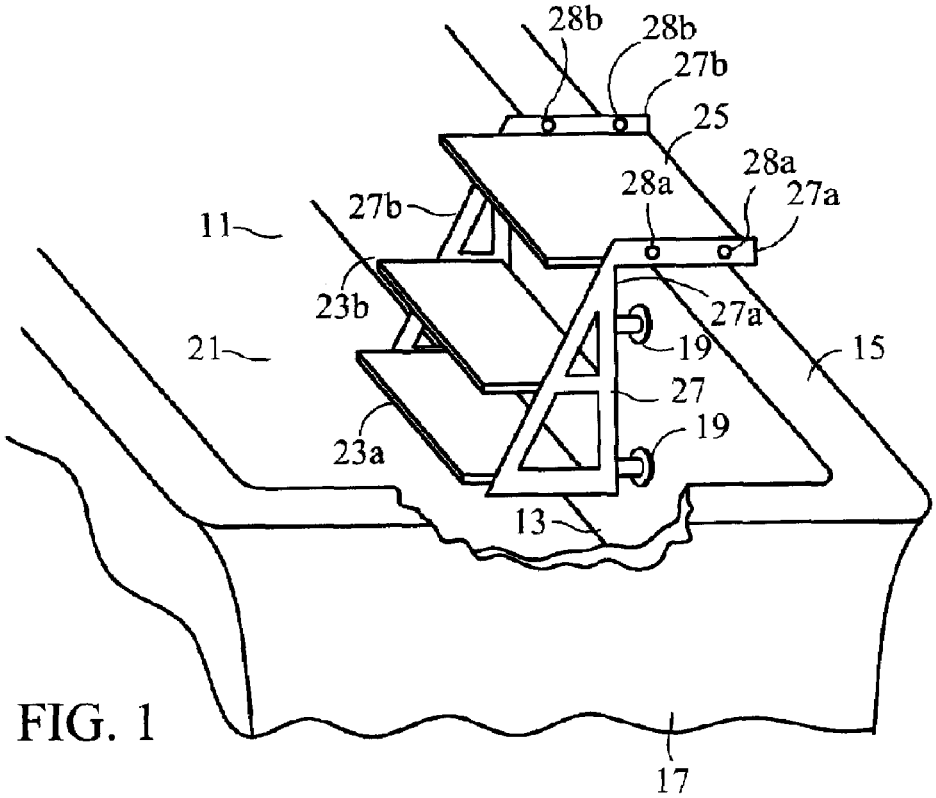
FIG. 1 shows the step base mounted to the side wall and gunwale of a vessel.
Figure 2:
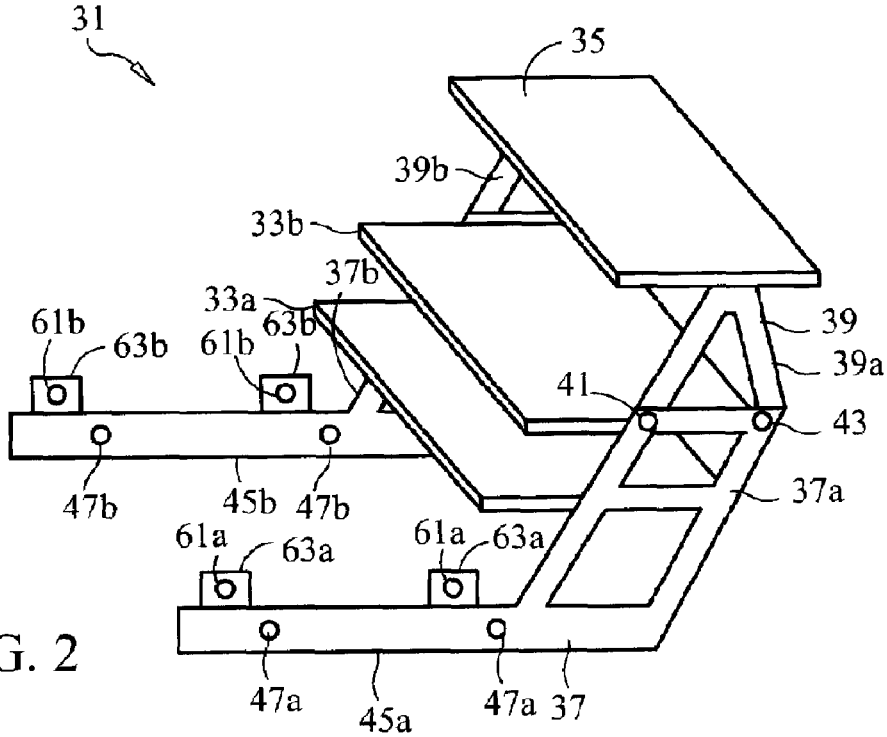
FIG. 2 shows the step extension separate from the step base.

The invention in a preferred embodiment, is shown in two parts, a step base 11, shown in FIG. 1, and an step extension 31, as shown in FIG. 2. As would be understood by those skilled in the art, one arrangement of the step extension 31 with the step base 11, is as shown in a preferred embodiment in FIG. 3. As would be understood by those skilled in the art, the invention is not limited to the step base and step extension shown and described in a preferred embodiment but extensions may be added to those shown and the base parts enlarged or augmented.

As shown in FIG. 1, the convertible step system comprises a step base 11, shown in a preferred embodiment, mounted to the side 13 and gunwale 15 of a boat shown as 17. The step base 11 is shown mounted to the side 13 of boat 17 by suitable fasteners 19. Any number of fasteners 19 may be used or any other suitable method for fastening the step system to the boat side 13, or deck 21, or gunwale 15, without departing from the disclosed principles of the invention.

The step base 11 comprises a plurality of steps, two shown in a preferred embodiment as 23*a* and 23*b* and a platform step or top step 25 which, in a preferred embodiment, is on or adjacent to the gunwale 15. The platform step 25 is shown on the gunwale 15, in a preferred embodiment, to provide a wider base of support relative to the other base steps 23*a* and 23*b* and may be above or adjacent the gunwale 15 or side 13, without departing from the disclosed inventive principles or may be replaced by any suitable top step. The number, size and displacement of the steps on the base step frame 27, or the size of the step base frame, may be varied without departing from the disclosed inventive principles.

Suitable step base frame 27 has side rail supports 27*a* on one side and 27*b* partially shown on the opposite side, and which support the steps 23*a* and 23*b* and platform step 25 and connect the base step 11 to the boat 17, by attachment devices 19, as would be known and understood by those skilled in the art. As explained with reference to FIG. 3, side rail supports 27*a* and 27*b*, are used to connect the step base 11 to the step extension 31.

Figure 2A:
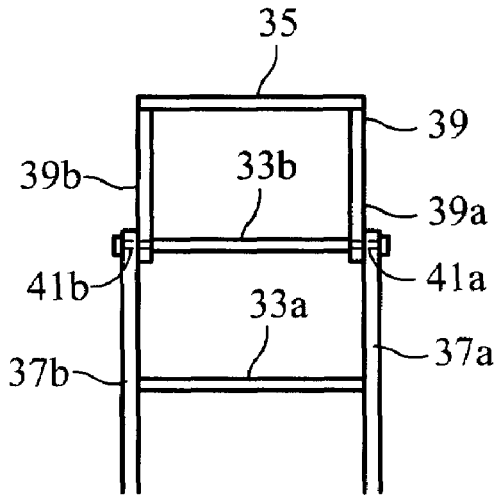
FIG. 2A and FIG. 2B, show in a front and side view, the method and system for mounting a translatable step on the step extension, shown in FIG. 2, to vary the vertical or horizontal length of the step extension.
Figure 2B:
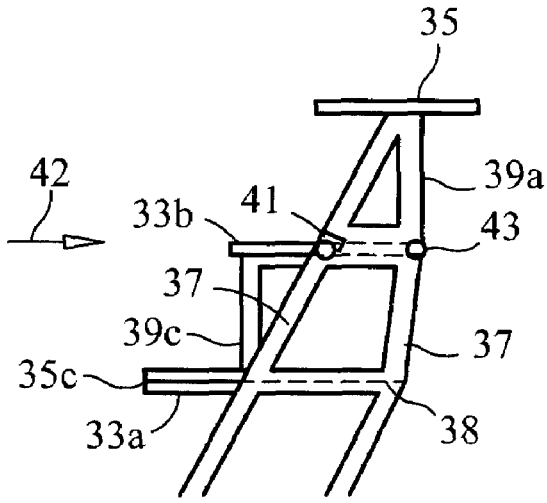

FIGS. 2A and 2B, partly show the step extension 31, as shown in FIG. 2, comprising a plurality of steps 33*a*, 33*b*, and translatable step 35, and its support shown as translatable frame 39, mounted on step extension frame 37, comprising frame side 37*a* and opposite matching frame 37*b*, with translatable step 35, mounted on translatable frame 39, for translation between an operable or extended position, as shown in FIG. 2A, and 2B and an inoperable or storage or nested position as shown and explained with regard to FIG. 2B. For explanation, FIG. 2B shows the translatable step 35 in its fully extended position and in its storage position, for comparision. The translatable step 35 is shown mounted for rotating movement on the translatable frame 39, connected to frame 37 by a hinge or pivot joint 41, joints 41*a* and 41*b*, shown in FIG. 2A, and held in place as shown by a holding and release device 43, in FIG. 2B. Any suitable device known to those skilled in the art may be used for pivot joint or for the holding device 43, a spring loaded pin or clevis pin and shackle or spring pin, for example, without departing from the principles of the invention.

A detail of the pivot 41 and release in a preferred embodiment, may be seen in FIG. 2A, showing in a front view, in the direction of arrow 42, as shown in FIG. 2B, with frame sides 37*a* and 37*b*, connected to opposing translatable frame sides 39*a* and 39*b* by pivot joint 41*a* and 41*b*.

The method and system for deploying the step extension 31, translatable step 35 on the translatable frame 39, from an extended position, for storage or to reduce the vertical height of the step extension 31, is shown in FIGS. 2A and 2B. As shown, the translatable frame 39 is mounted to translatable step 35, for pivoting movement on pivot joint 41*a*, shown connecting respective frame sides 37*a* and 39*a* and pivot joint 41*b*, shown connecting respective frame sides 37*b* and 39*b*.

The translatable step 35 is shown rotated to its full height position in FIGS. 2A and 2B and in the same view of FIG. 2B, is shown (in phantom behind frame 37), rotated counter clockwise about pivot joint 41 to its storage position indicated by numeral 38. As shown in the storage position of FIG. 2B, the position of translatable step 35 in its storage position as shown by numeral 35*c* is disposed opposite step 33*a*, and the position of translatable frame side 39*a*, as shown by numeral 39*c*, when in its storage position.

Figure 3:
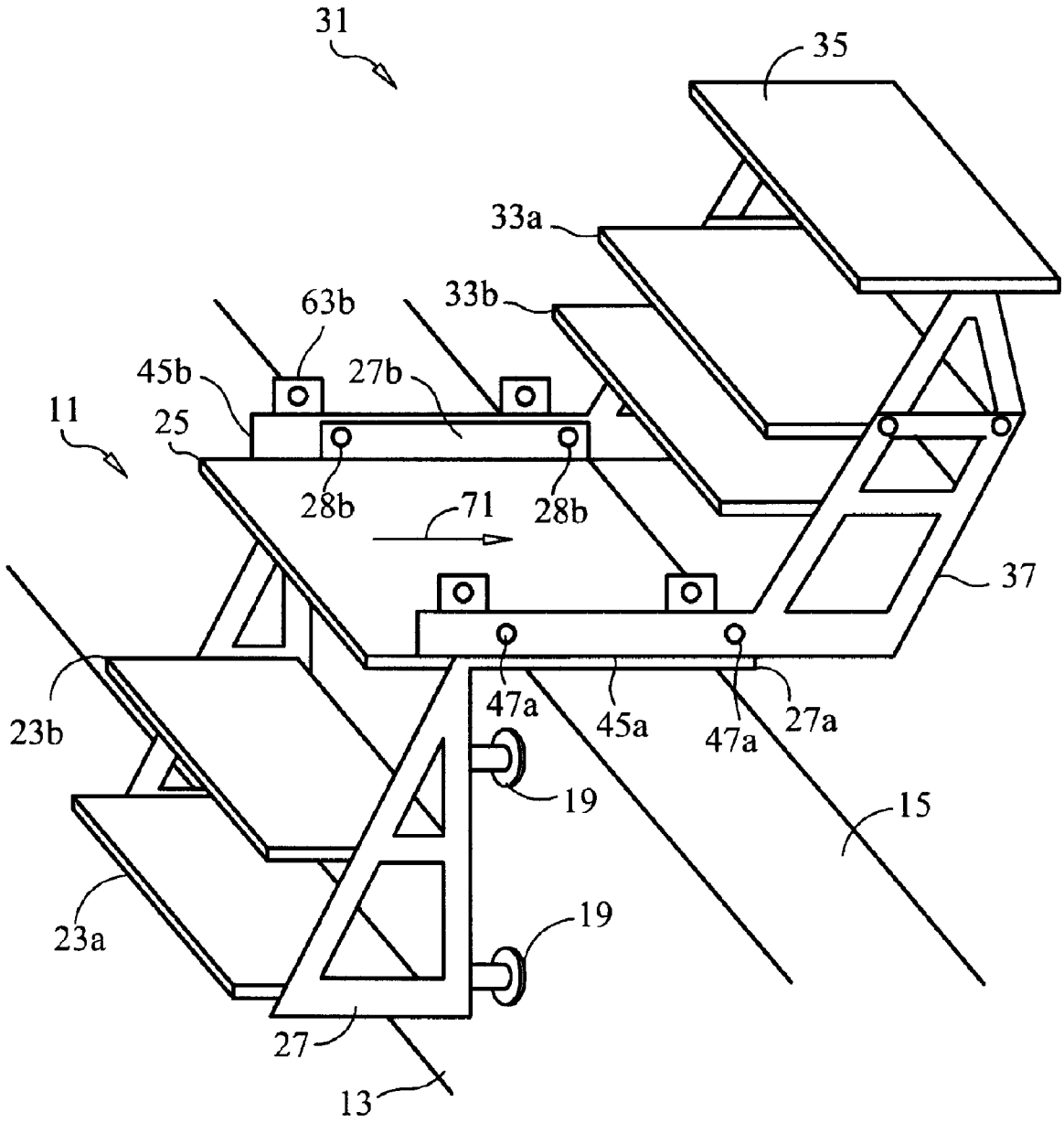
FIG. 3 shows the mounting of the step base of FIG. 1 and the step extension of FIG. 2, in a first position to achieve maximum vertical height.

Referring to FIG. 2, the step extension 31, is shown as comprising a connection system using a set of side rails 45*a* and 45*b* for mounting the step extension to the step base 11, side rails 27*a* and 27*b*, as shown in FIG. 3.

The connection system described above as shown in a preferred embodiment, in FIG. 3, and for the step base 11, is shown located adjacent the platform step 25, but as would be apparent to those skilled in the art, the proximity of the disclosed connection system mountings, as described above, to the platform step may be varied without departing from the disclosed principles of the invention.

For the purpose of explanation, the system for connecting the step base 11 to the step extension 31, is described as step connection system, and the respective parts are described as the step base connection and the step extension connection or as step base connection mountings or as step extension connection mountings.

As shown in a preferred embodiment the connection system mountings for the step extension 31, shown in a preferred embodiment, comprise side rail opposed openings 47*a* in side rail 45*a* and 47*b* in side rail 45*b,* within the step extension frame 37. As separate set of displacement mountings comprising opposed openings 61*a* and 61*b* in displacement tabs 63*a* and 63*b* are shown for mounting the step extension to the step base in a position displaced from the mounting position shown in FIG. 3, and as explained for FIG. 6.

Figure 5:
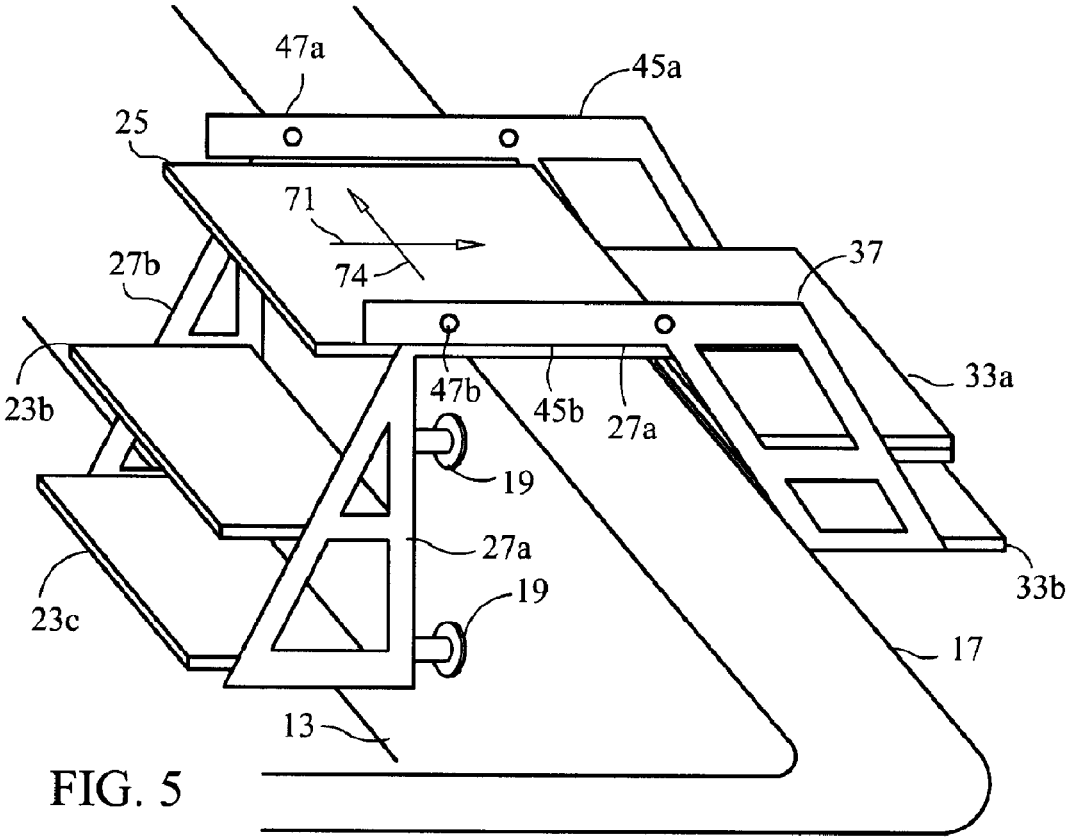
FIG. 5 shows a mounting of the step extension on the step base, translated relative to the first position of FIG. 3, to achieve maximum horizontal length in a second position.
Figure 6:
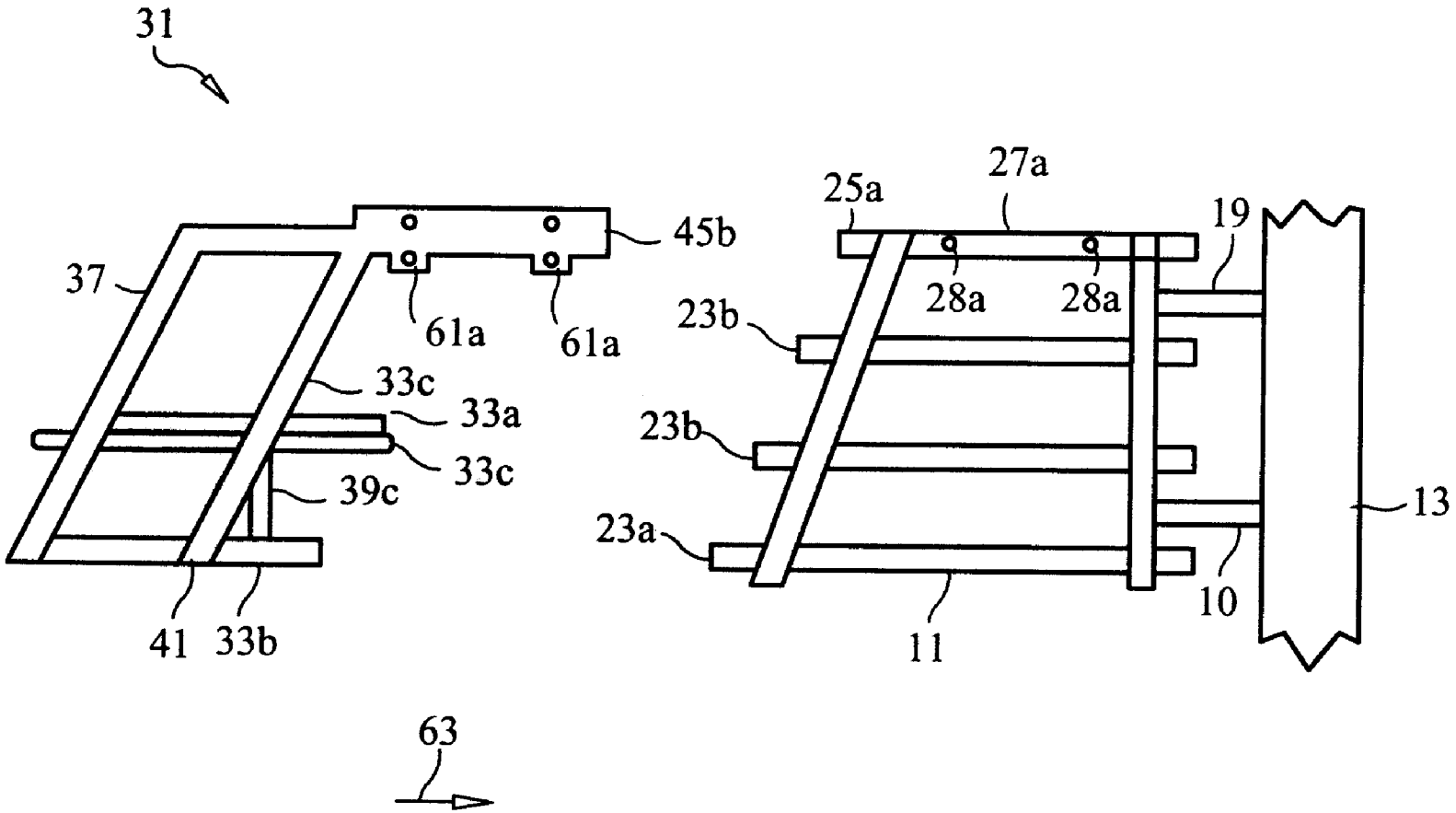
FIG. 6 shows another mounting of the step extension to the step base, in an exploded view, for storage, and in a third position relative to the first position.

In a preferred embodiment, as shown in FIG. 3, in a first position and in FIG. 5 in a second position, the connection system mountings on step base 11, connecting the step extension frame 31, are the side rail 27*a* and 27*b* of the step base 11, and as shown with step base openings 28*a* and 28*b,* on step base side rails 27*a* and 27*b* arranged to be disposed opposite the connecting system mountings on step extension 31, shown in a preferred embodiment as step extension 31 side rail openings 47*a* and 47*b,* on side rails 45*a* and 45*b,* respectively, or as shown in FIG. 6, for a third position, side rail opening 61*a* and 61*b.* As would be understood by those skilled in the art, the side rail openings 61*a* and 61*b,* in the side rail tabs 63*a* and 63*b,* respectively are displaced from the connecting system mountings 47*a* and 47*b,* in step extension side rails 45*a* and 45*b,* openings for a preferred embodiment to show how the relative displacements to the step base and the step extension may varied in the aforesaid first, second, or third positions. As understood by those skilled in the art, the invention may be used according to its inventive principles with one or more sets of connection system mountings on the step base and step extension, respectively.

Figure 4A:
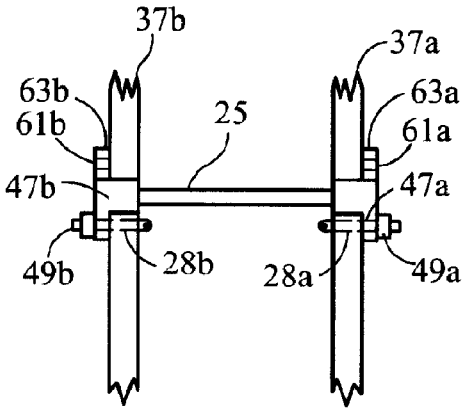
FIGS. 4A and 4B, shows a detail of how the side rails of the step base and step extension may be aligned for connecting the step base to the step extension for maximum vertical height as shown in FIG. 3.
Figure 4B:
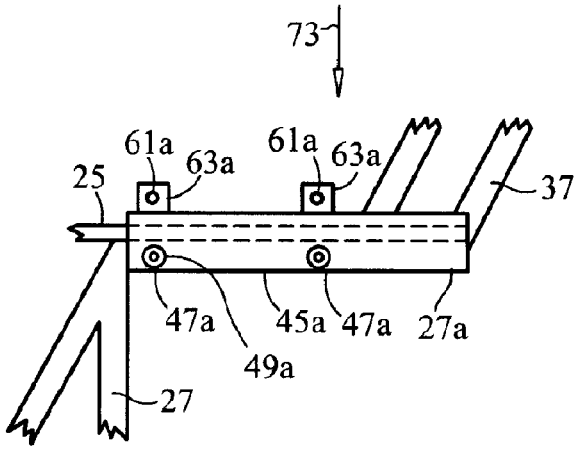

As shown for a preferred embodiment, the step extension 31, relative to its position on step base 11, as shown in FIG. 3, may be placed relative to step base 31, to extend the step base vertically in a first position, or placed in a second position, relative to the first position rotated about an axis 71, passing through a plane formed by the connection system mountings on the step extension 31, a shown in FIG. 3, to extend the step base horizontally, or in a third position, relative to the first position, rotated first about axis 71, as for the second position and then rotated about an axis 73 passing through the plane formed by the connection system mountings on the step extension, as shown in FIG. 4B, to place the step extension in a nested position inside the step base 11 as shown in a preferred embodiment in FIG. 6. As would be understood by those skilled in the art, the arrangement for rotating and inverting the step extension 31, relative to its arrangement as shown in FIG. 3 or in FIG. 5, or in FIG. 6, may be varied without departing from the disclosed principles of the invention. The step extension 31 may be moved from its second position shown in FIG. 5 to its third position shown in FIG. 6, by rotating the step extension 31 about an axis 74 passing through the plane defined by the step base side rails 27*a* and 27*b,* for example as shown in FIG. 5.

FIGS. 4A and 4B, shows in a partial view, and for a preferred embodiment, a system and method, for connecting the step base 11 to the step extension 31. The view in FIG. 4A is in the direction of arrow 42, as shown in FIG. 2B. A side view is shown in FIG. 4B.

As shown for a preferred embodiment in FIG. 4A, a securing device, for example as shown in a preferred embodiment in FIGS. 4A and 4B, a spring loaded pin 49*a* and 49*b,* suitably braced are shown used for retention of the side rail 27*a* against side rail 45*a* and side rail 27*b* against side rail 45*b,* as would be known to those skilled in the art. Similarly, any other suitable fastening device, as would be known to those skilled in the art may be used without departing from the principles of the disclosed invention.

The step extension frame 37 may be held securely to the step base frame 27, by means of spring loaded pins 49*a* and 49*b,* in openings 47*a* and 47*b,* for the step extension 31 and 28*a* and 28*b,* for step base 11, as shown in a preferred embodiment, with reference to FIG. 4A and FIG. 4B.

In FIGS. 4A and 4B, is shown a preferred embodiment where the step extension side rails 45*a* and 45*b,* are mounted as separate pieces to step extension frame 37. As would be known to those skilled in the art, the step base or step extension, may be fabricated in a unitary or composite pieces, without departing from the disclosed inventive principles.

As would be known to those skilled in the art, spring loaded pins 49*a* and 49*b,* may be pulled outwardly of the side rails 47*a* and 47*b,* in step extension 31, or side rails 27*a* and 27*b,* in step base 11, to release the step extension 31, from the step base 11, as would be known to those skilled in the art, any suitable holding devices or releases may be used in addition to those shown here without departing from the disclosed inventive principles.

For maximum horizontal length, the step extension in its first position shown in FIG. 3, may be translated about axis 71, as shown in FIG. 3, to place the step extension 31 in a second position for maximum horizontal length. As shown in FIG. 5, when in the second position, and in a disclosed preferred embodiment, the translatable step 35 is in its storage position as indicated by numeral 35*c,* as shown in FIG. 2B. In FIG. 5, the connection of the step base 11 to the step extension 31 in the second position relative to the first position as shown in FIGS. 4A and 4B and FIG. 3, would be the same, with the exception that the step base side rail 45*a* would be disposed opposite step base side rail 27*b* and side rail 45*b* would be disposed opposite side rail 27*a.*

In FIG. 6 is shown the step base 11 and the step extension 31 in an exploded view in the third position relative to the first position and in a nested or storage position, for travel or for example when the proximity of the dock or landing to the board 17, is close so the step extension is not needed. In a preferred embodiment, an alternative connection system mounting is shown, displaced from the connection system mountings 27*a,* 27*b,* 28*a,* 28*b,* and 45*a* and 45*b,* and 47*a* and 47*b,* shown used for the first or second positions, as shown in FIGS. 3 and 5 may be used for example where more spacing or displacement may be needed between the steps 35*c,* 33*a* and 33*b* of the step extension 31 and steps 25, 23*a* and 23*b,* of the step base 11.

In this connection, as shown for a preferred embodiment in FIG. 6, the connection mounting system on the step extension 31 side rail 45 is equipped with a set of separate mountings on side rail 45, comprising opposed openings 61*a* and 61*b* in displacement tabs 63*a* and 63*b* shown for mounting the step extension 31 to the step base 11 in a position displaced from the mounting position shown in FIG. 3. As shown the mounting holes 61*a,* are arranged for aligning the holes 61*a* with holes 28*a* on the step base and to mount the step extension vertically displaced from the position it would have when the holes 47*a* and 47*b,* were aligned with step base holes 28*a* and 28*b.* As would be understood by those skilled in the art, the alignment of opposed openings 61*b* in displacement tabs 63*b,* with opening 28*b* on step base side rail 27*b,* would be the same as the alignment of the openings 61*a* and 28*a.*

The step extension 31 may be placed in the storage position as shown in FIG. 6, relative to its position in FIGS. 4A and 4B, and FIG. 3, by rotating the step extension 31 about axis 71, as shown in FIG. 3 and about axis 73 as shown in FIG. 4B. Or as would be understood by those skilled in the art, the position of the step extension, shown in FIG. 3, may be rotated about an axis into the plane of FIG. 3 and passing though the side rials 45*a* and 45*b*, to bring it into the position shown in FIG. 6. As would be understood by those skilled in the art, the step extension in its storage position would be displaced in the direction of arrow 63 to move the step extension in the third position into a nested arrangement with the step base 11, so the steps 33*a*, 33*b* and 35 would be nested within steps 23*b* and 25. An additional step 23*c* is shown between step 23*b* and 25 to demonstrate the arrangement of the steps may be varied without departing from the principles of the disclosed invention.

The use of the displacement mountings 61 may be in other locations on the step base or the step extension, to vary the or displacement position of the step base and the step extension when connected to each other.

As shown for a preferred embodiment, in FIGS. 3, 5, and 6, the steps 23*a*, 23*b*, 25 in the step base 11 are substantially aligned with the steps 33*a*, 33*b*, 35, in the step extension 31. In the disclosed preferred embodiment, the plane defined by the step extension mountings, defined in a preferred embodiment, by frame side rails 45*a* and 45*b* or by step base mountings defined in a preferred embodiment, by frame side rails 27*a* and 27*b*, or the platform step 25, may be a reference for axis 71 or 73 and the orientation of the step base 11 and the step extension in a first or vertical extension position or in a second or horizontal extension position, or in a third nesting or storage position.

As shown for a preferred embodiment, the step base uses the platform step 25 as a common step in the connecting step base and step extension system as shown in FIGS. 3, 5, and 6. However, as would be understood by those skilled in the art, the step extension 31 may include a step for use as a common step in the connected system as shown in FIGS. 3, 5 and 6. As may be seen in the disclosure of a preferred embodiment, the steps of the step base 31 and step extension are aligned in a step direction from the bottom step to the top step or from one end of the step base or step extension to the opposed end, respectively. As would be understood by those skilled in the art, the alignment of the steps may define a first axis 71 in the direction of the steps or a second axis 74 orthogonal to the first axis and transverse to the direction of the first axis. For example, the axis of rotation 41, as shown in FIG. 2B, would be substantially parallel to said second axis.

What is claimed is:

1. An expandable self storing ladder used aboard a vessel, and adaptable for length or height extension to accommodate varying displacements of the vessel from an intended location, comprising, first means for stepping from a vessel;

said first means including means for steps;

said first means including second means for connection with said first means and for extending said first means in a plurality of positions or directions;

said second means including third means for detachably connecting said second means in a first position with said second means extending in a first direction for vertical extension, and for detachably connecting said second means in a second position with said second means extending in a second direction for horizontal extension.

2. The ladder of claim 1, wherein, said third means includes means for connecting said second means inverted in said second position relative to said first position.

3. The ladder of claim 1, wherein said third means includes means for connecting said second means in a third position for storage.

4. The ladder of claim 3, wherein, said means for connecting said second means in said third position for storage, includes means for connecting said second means, rotated and inverted, relative to said first position.

5. The ladder of claim 4, wherein, said means for connecting said second means to said first means in said third position for storage, includes means for nesting said means for steps.

6. The ladder of claim 4, wherein said third means for connecting includes a first and a second set of displaced connections for connecting said second means in said first position or said third position, respectively.

7. The ladder of claim 1, wherein, said second means includes means for steps and a fourth means for retracting at least a part of said means for steps of said second means into a storage position whereby the length of said second means is reduced.

8. The ladder of claim 7, wherein said fourth means includes means for rotating at least one of said means for steps of said second means into a nested position in said second means.

9. The ladder of claim 1, wherein, said third means includes means for mounting said second means on said first means for extending said first means from said vessel to a displaced location, in a horizontal or vertical direction.

10. The ladder of claim 1, wherein said first means includes means for use as a common step with said second means, in said first position or said second position.

11. An adjustable step ladder compensating for varying displacement of a boat from the surface of a dock due tide changes or for a changed arrangement of docking facilities, comprising, a step base ladder, including a set of aligned steps;

a step extension ladder including a set of aligned steps;

a connection system including step base connection system mountings and a step extension connection system mountings, arranged for connection in a first position for extending said step base vertically, in a second position for extending said step base horizontally, or in a third position for nesting said step extension with said step base for storage.

12. The adjustable step ladder of claim 11, wherein, said step base includes a platform step and said step base connection mountings are disposed adjacent said platform step.

13. The adjustable step ladder of claim 11, wherein, said step extension connection mountings and said step extension connection mountings include respective openings adapted to used with a securing device.

14. The adjustable step ladder of claim 13, wherein said securing device is a pin adapted to pass through said respective openings.

15. The adjustable step ladder of claim 11, wherein said step extension system mountings define a plane and said step extension in said second position is disposed relative to said first position, about a first axis in said plane substantially aligned with said steps.

16. The adjustable ladder of claim 11, wherein said step extension system mountings define a plane and said step extension in said third position is disposed relative to said first position about a second axis in said plane substantially aligned in a direction orthogonal with said steps.

17. The adjustable step ladder of claim 16, wherein, step base connection system mountings and a step extension connection system mountings, are arranged in opposition, and said said steps of said step base and said step extension, are nested.

18. The adjustable step ladder of claim 11, wherein, said step extension system mountings define a plane and said step extension in said second position is disposed relative to said first position, about a first axis in said plane or wherein said step extension in said third position is disposed relative to said first position about an axis in said plane orthogonal to said first axis.

19. The adjustable step ladder of claim 18, wherein, said step base includes a platform step and said step base connection mountings are disposed adjacent said platform step.

20. The adjustable step ladder of claim 11, wherein said step extension includes a step extension frame and a translatable frame mounted to step extension frame for translation between an extended position or a storage position.

21. The adjustable step ladder of claim 20, including a translatable step mounted on said translatable frame and said translatable frame is mounted on said step extension frame for rotation of said of said translatable step to said storage position wherein said translatable step is nested in said step extension.

22. The adjustable step ladder of claim 21, wherein said translatable frame is mounted on said step extension frame for rotation.

23. A method for using an expandable self storing ladder used aboard a vessel, to accommodate varying displacements of the vessel from an intended transfer location, comprising the steps of, attaching a step base to a vessel;

arranging a step extension on said step base in a first position for extending said step base vertically, arranging said step extension on said step base in a second position for extending said step base horizontally, or in a third position for nesting said step extension with said step base.

24. The method of claim 23, including the step of mounting said step extension in first position with the steps of said step base substantially aligned with said steps of said step extension in a step alignment.

25. The method of claim 24, including the step of arranging said step extension in said second position relative to said step extension in said first position by rotating said step extension about an axis substantially aligned with said steps of said step extension or step base.

26. The method of claim 24, including the step of arranging said step extension in said third position relative to said step extension in said first position by rotating said step extension about an axis substantially in a plane orthogonal to said step alignment.

* * * * *